US008833880B2

(12) United States Patent
Chung

(10) Patent No.: US 8,833,880 B2
(45) Date of Patent: Sep. 16, 2014

(54) TRACK-BASED SYNCHRONOUS INTERLINKING DEVICE

(71) Applicant: Nan Juen International Co., Ltd., New Taipei (TW)

(72) Inventor: Jung-Chang Chung, New Taipei (TW)

(73) Assignee: Nan Juen International Co., Ltd., New Taipei (TW)

( * ) Notice: Subject to any disclaimer, the term of this patent is extended or adjusted under 35 U.S.C. 154(b) by 0 days.

(21) Appl. No.: 13/903,718

(22) Filed: May 28, 2013

(65) Prior Publication Data

US 2014/0009053 A1 Jan. 9, 2014

(30) Foreign Application Priority Data

Jul. 3, 2012 (TW) ..... 101212810 U

(51) Int. Cl.

*A47B 88/00* (2006.01)
*A47B 88/04* (2006.01)
*A47B 88/10* (2006.01)

(52) U.S. Cl.

CPC ..... *A47B 88/0466* (2013.01); *A47B 88/10* (2013.01); *A47B 2210/0008* (2013.01)
USPC ..... 312/334.11; 312/334.9; 312/334.17; 312/334.38

(58) Field of Classification Search

USPC ..... 312/334.6, 334.27, 334.31–334.43, 312/334.8, 334.9, 334.11–334.22
See application file for complete search history.

(56) References Cited

U.S. PATENT DOCUMENTS

| | | | | | |
|---|---|---|---|---|---|
| 3,778,120 | A * | 12/1973 | Hagen et al. | 384/18 |
| 3,912,341 | A * | 10/1975 | Stein | 384/18 |
| 4,662,761 | A * | 5/1987 | Hoffman | 384/18 |
| 5,344,228 | A * | 9/1994 | Kovarik et al. | 312/334.9 |
| 5,570,943 | A * | 11/1996 | Schroder et al. | 312/334.11 |
| 5,882,100 | A * | 3/1999 | Rock | 312/334.34 |
| 7,213,896 | B2 * | 5/2007 | Chi | 312/334.8 |
| 7,296,863 | B2 * | 11/2007 | Lam et al. | 312/334.6 |
| 7,448,704 | B2 * | 11/2008 | Lam et al. | 312/333 |
| 8,277,003 | B2 * | 10/2012 | Milligan et al. | 312/334.6 |
| 8,414,094 | B2 * | 4/2013 | Chi et al. | 312/333 |
| 8,474,926 | B2 * | 7/2013 | Prentner | 312/334.16 |
| 2006/0097609 | A1 * | 5/2006 | Milligan et al. | 312/319.1 |
| 2007/0057609 | A1 * | 3/2007 | Lam et al. | 312/334.31 |
| 2009/0195131 | A1 * | 8/2009 | Chi et al. | 312/319.1 |

FOREIGN PATENT DOCUMENTS

| | | | | |
|---|---|---|---|---|
| DE | 4443063 C1 * | 12/1995 | | A47B 88/10 |
| JP | 05123227 A * | 5/1993 | | A47B 88/14 |
| TW | 313788 | 8/1997 | | |

* cited by examiner

*Primary Examiner* — Hanh V Tran
(74) *Attorney, Agent, or Firm* — Muncy, Giessler, Olds & Lowe, P.C.

(57) ABSTRACT

A track-based synchronous interlinking device having a lower track with a knurl pattern; a central track completing slides relative to the lower track; and an external track completing slides relative to the central track and having a knurl pattern. A synchronous interlinking device includes a roller bracket positioned at the central track and a roller featuring flexibility and elasticity, pivoted to the roller bracket, and allowing both sides to resist the lower track's knurl pattern and the external track's knurl pattern. The synchronous interlinking device completes smooth and accurate relative slides based on a synchronous triple-track interlinking operation among the lower track, the central track and the external track.

10 Claims, 6 Drawing Sheets

TRACK-BASED SYNCHRONOUS INTERLINKING DEVICE

BACKGROUND OF THE INVENTION

1. Field of the Invention

The present invention relates to a slide track, particularly a track-based synchronous interlinking device used in a synchronous interlinking mechanism and facilitating superior smooth and accurate slides and economic efficiency.

2. Description of the Related Art

Cabinets with pull-out drawers installed have been extensively applied in all kinds of storage equipment currently wherein each of the drawers to be conveniently pulled or pushed by users is usually integrated with tracks at its both sides for positioning and guiding the drawer, for instance, an internal track and an external track between which a ball bearing carriage is installed. As one component installed between slide tracks for a smooth sliding operation, the ball bearing carriage passing through a first track usually collides a second track, which is not synchronously interlinked to the first one, for continuous movement, causing vibrations, and deteriorating a sliding process.

A technique based on synchronous triple-track interlinking tracks to overcome the above drawbacks has been available now. As shown in FIGS. 1 and 2, a known track-based synchronous interlinking mechanism comprises a lower track 91, a central track 92, an external track 93 and a toothed wheel 95: the lower track 91 comprises (a) a dead plate 911 which is fixed on a cabinet wall (not shown in figures), (b) a slide track space 912 inside, and (c) a row of ruler-like sawteeth 913 beside the slide track space 912; the central track 92 comprises (a) a central track bottom 921 moveably held in the slide track space 912 and coordinating the lower track 91 (slide track space 912) to accommodate a ball bearing carriage 94 in between, (b) a central track top 922, and (c) a toothed wheel hole 923; the external track 93 linking a cabinet or a drawer (not shown in figures) internally develops a slide track space 930 in which the central track top 922 is moveably held, allows a ball bearing carriage 96 to be accommodated between the slide track space 930 (external track 93) and the central track top 922, and further comprises a row of ruler-like sawteeth 932 at one side; the toothed wheel 95 is pivoted to the toothed wheel hole 923 on the central track 92 and engages both the sawteeth 913 of the lower track 91 and the sawteeth 932 of the external track 93 so that the central track 92 is synchronously driven and shifted by the sliding external track 93 through the sawteeth 932 and the toothed wheel 95, both of which engage each other.

The track-based synchronous interlinking mechanism based on the prior art for an effective synchronous interlinking operation still has some drawbacks deserved to be corrected. For example, slide tracks' heights are not reduced because of a toothed wheel 95 and a row of ruler-like sawteeth 913, 932 installed between slide tracks; a toothed wheel and a row of ruler-like sawteeth, both of which are high-cost components, are uneconomic and unideal design; down force (weight) induced by the tilted external track deviates the lower track's axle and causes an unsmooth operation or departure of the track assembly from a cabinet in the case of a toothed wheel and a row of ruler-like sawteeth manufactured with rigid material. Therefore, the abovementioned drawbacks in a conventional track-based synchronous interlinking mechanism deserve to be overcome by persons skilled in the art.

Accordingly, the inventor having considered imperfect structural design and drawbacks of the prior art and attempted to optimize a solution, that is, a track-based synchronous interlinking device moving smoothly and accurately and conforming to a demand for economic design, has studied and developed the present invention for benefiting the general public and promoting development of the industry.

SUMMARY OF THE INVENTION

The present invention is intended to provide a track-based synchronous interlinking device effectively satisfying a synchronous triple-track interlinking operation during relative slides, keeping superior smooth and accurate slides, conforming to economic efficiency and a demand for better track design, and positively promoting practicability, texture perception, and competitiveness of a product.

The present invention is based on the following technical measures to realize the above purposes: a lower track on which a knurl pattern is designed; a central track completing slides relative to the lower track; an external track completing slides relative to the central track and decorated with a knurl pattern; a synchronous interlinking device comprising a roller bracket positioned at the central track and a roller which is a flexible or elastic component pivoted to the roller bracket and allows its both sides to contact the lower track's knurl pattern and the external track's knurl pattern, respectively.

For technical features and effects in terms of the present disclosure completely comprehended and recognized, the preferred embodiments and accompanying drawings are thoroughly described hereinafter.

DETAILED DESCRIPTION OF THE PREFERRED EMBODIMENTS

Figure 1:
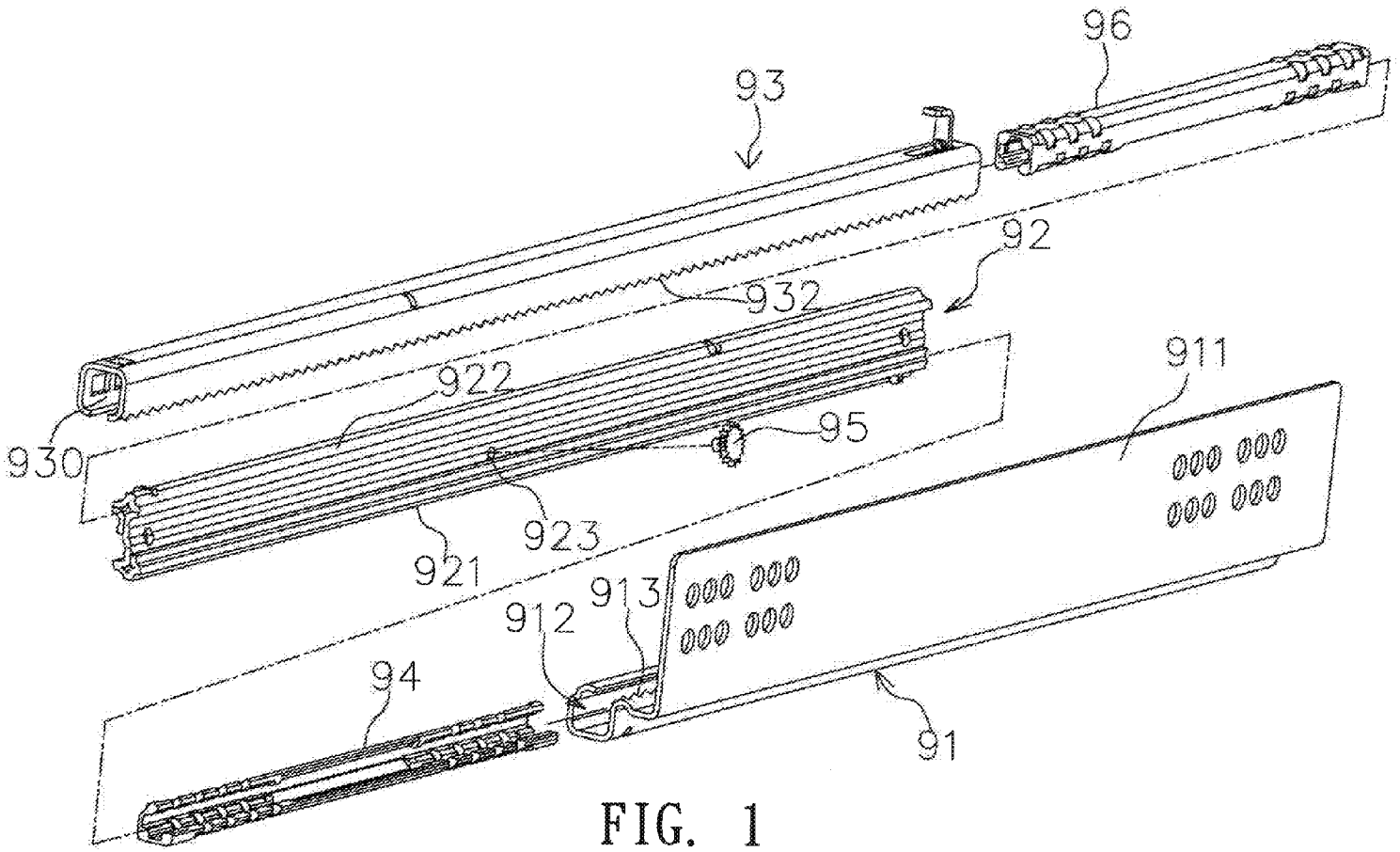
FIG. 1 (Prior Art)
FIG. 1 is an exploded view of a track-based synchronous interlinking device based on the prior art.
Figure 2:
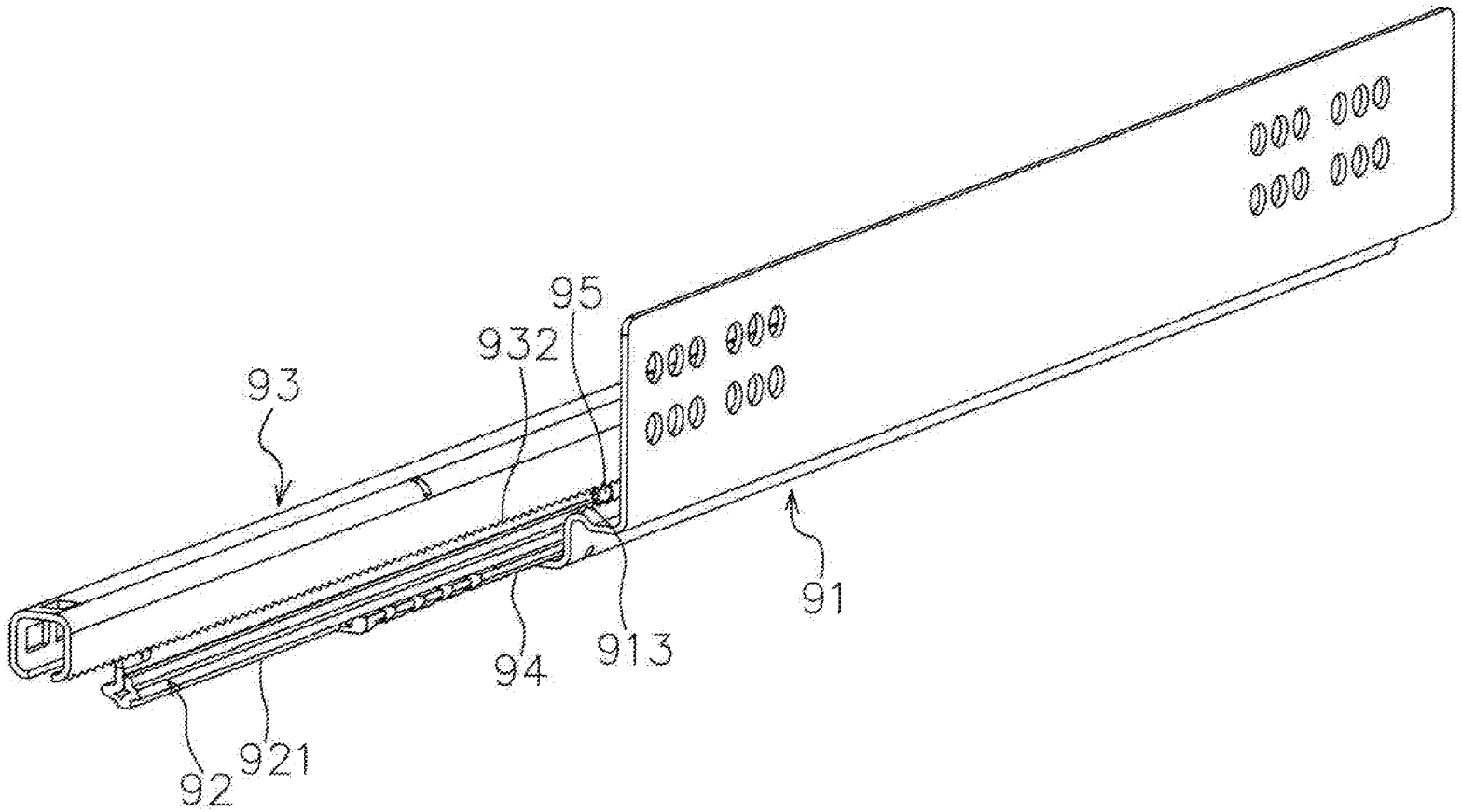
FIG. 2 (Prior Art)
FIG. 2 is a schematic view of an assembled track-based synchronous interlinking device based on the prior art.
Figure 3:
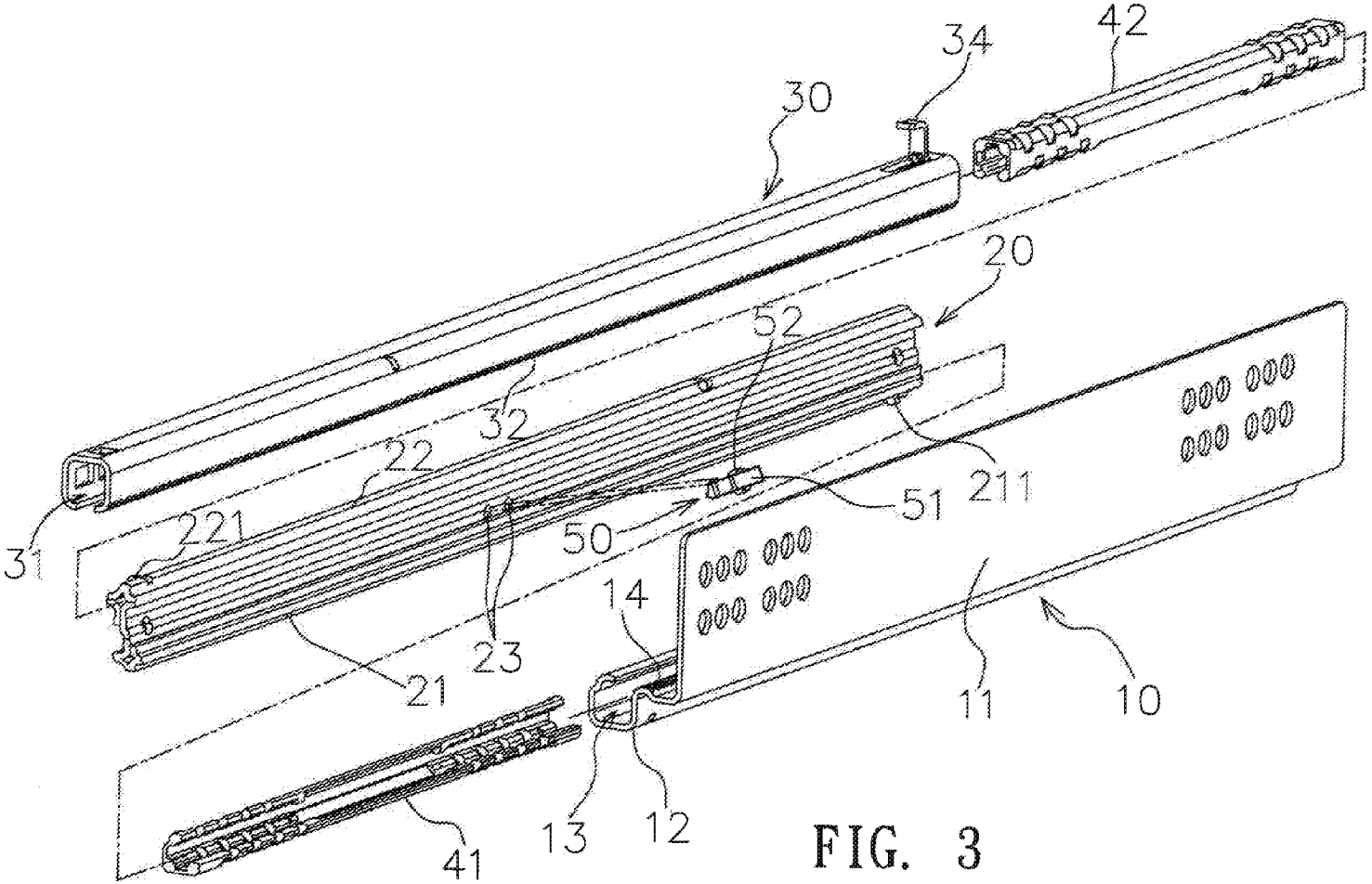
FIG. 3 is an exploded view of the present invention.
Figure 4:
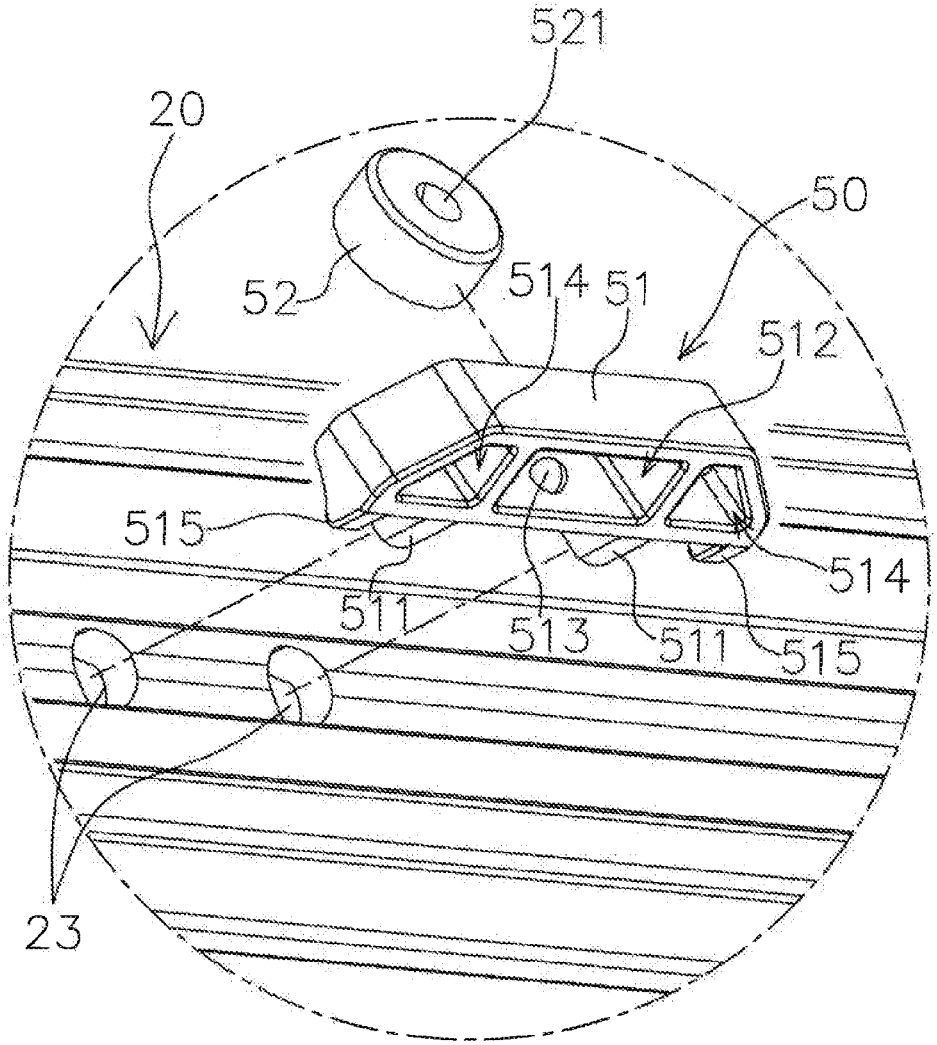
FIG. 4 is a partial enlargement view of the present invention.

Referring to FIGS. 3 and 4 which illustrate the present invention of a track-based synchronous interlinking device comprises a lower track 10, central track 20, external track 30 and a synchronous interlinking device 50. The lower track 10 comprises a track part 12 and a dead plate 11: the track part 12 (lower track 10) developing a slide track space 13 internally comprises a knurl pattern 14 which is beside the slide track space 13 and equal to or shorter than the track part 12 (lower track 10) in length; the track part 12 (lower track 10) at the knurl pattern 14 develops an oblique convex away from the dead plate 11 in order to prevent deformation when any load is applied on the track part 12; the dead plate 11 is fixed on a cabinet wall (not shown in figures) for positioning the lower track 10. The central track 20 comprises a central track bottom 21 and a central track top 22: the central track bottom 21 moveably held in the slide track space 13 and provided with a limit stop 211 at its front allows a ball bearing carriage 41 comprising ball bearings thereon to be installed and smoothly slide between the central track bottom 21 (central track 20) and the slide track space 13 (lower track 10); the central track top 22 is also provided with a limit stop 221 at its rear part; the central track 20 further comprises two pilot holes 23 thereon (or at one side). The external track 30 connected to a cabinet (drawer) and internally developing a slide track space 31 in which the central track top 22 is moveably held allows a ball bearing carriage 42 comprising ball bearings thereon to be installed and smoothly slide between the slide track space 31 (external track 30) and the central track top 22 (central track 20); the external track 30 is decorated with a knurl pattern 32 thereon (or at its bottom), which is equal to or shorter than the external track 30 in length, and further provided with a pulling part 34 at its front.

The synchronous interlinking device 50 comprises a roller bracket 51 and a roller 52: the roller bracket 51 comprises two locators 511 which are located at both sides and inserted into and positioned at the pilot holes 23 on the central track 20 and develops a hollow roller accommodation space 512 in which two raised joining columns 513 corresponding to each other and centrally situated at both laterals parallel to the central track 20 are designed; the roller bracket 51 further develops a hollow side compartments 514 at both ends of the roller accommodation space 512 for enhanced compressive elasticity and comprises two resisting parts 515 outside the locators 511 for stronger stability during positioning; the roller 52 featuring flexibility and elasticity has an axial hole 521 to which the two joining columns 513 in the roller accommodation space 512 are pivoted and positioned; moreover, the roller 52 positioned in the roller bracket 51 has a diameter larger than the inner depth of the roller accommodation space 512 and protrudes from the roller accommodation space 512 (roller bracket 51).

Figure 6:
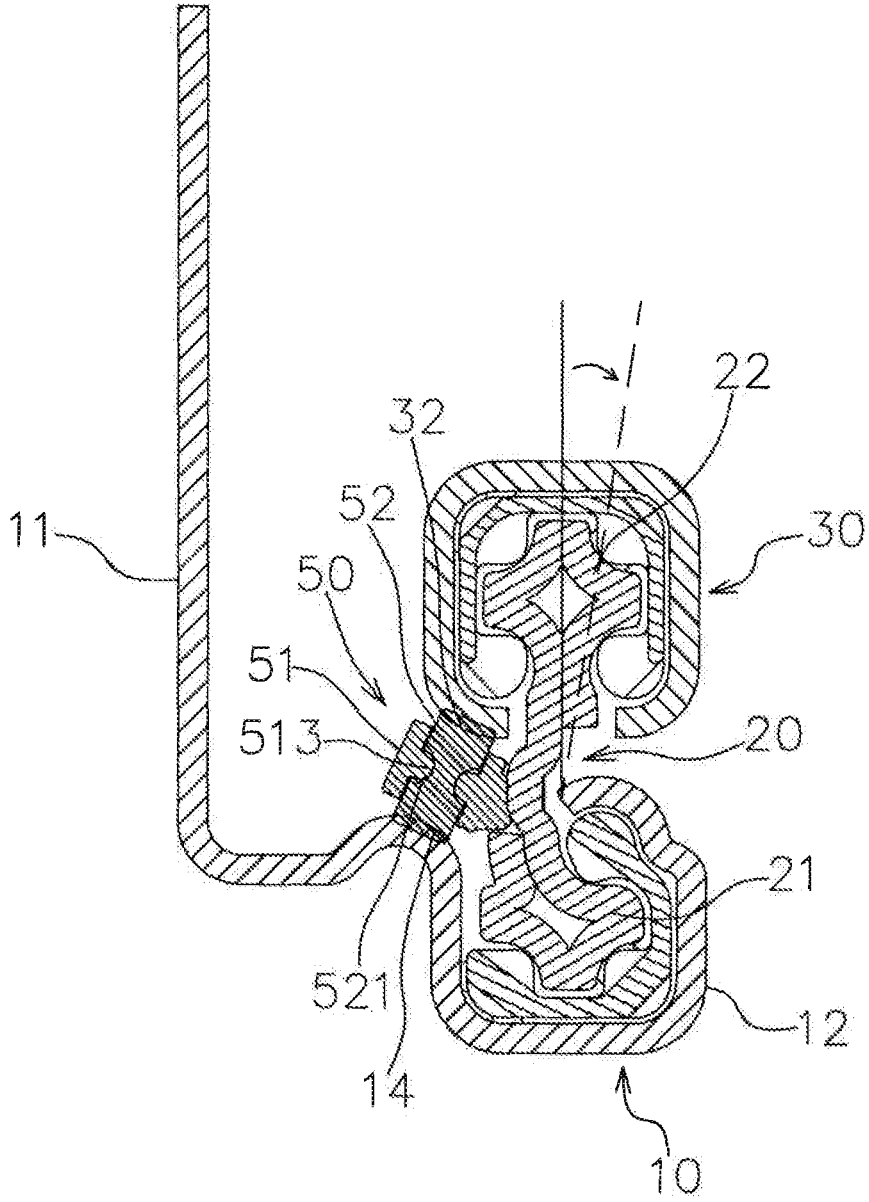
FIG. 6 is a partial enlargement section view of the present invention.

Moreover, the roller 52 which has been pivoted to and positioned in the roller bracket 51 allows its both sides to resist the knurl pattern 14 on the lower track 10 and the knurl pattern 32 on the external track 30. As such, friction induced by contacts between the roller 52 and the knurl patterns 14, 32 facilitates relative interlinking. As shown in FIG. 6, the knurl pattern 14 on the lower track 10 and the knurl pattern 32 on the external track 30, both of which are obliquely opposite to each other, allows the roller 52 in between to slant. As such, a backlash compensation which is created between the knurl patterns 14, 32 stabilizes the running roller 52 with no derailment and minor noise generated. The design of the slanted roller 52 or the knurl patterns 14, 32 which are obliquely opposite to each other further divides an oblique load applied on the external track 30 into a horizontal component and a vertical component but less total vertical burden, resisting the horizontal component and making a cabinet or a drawer sway or shift less for preferable structural stability and service life.

Figure 5:
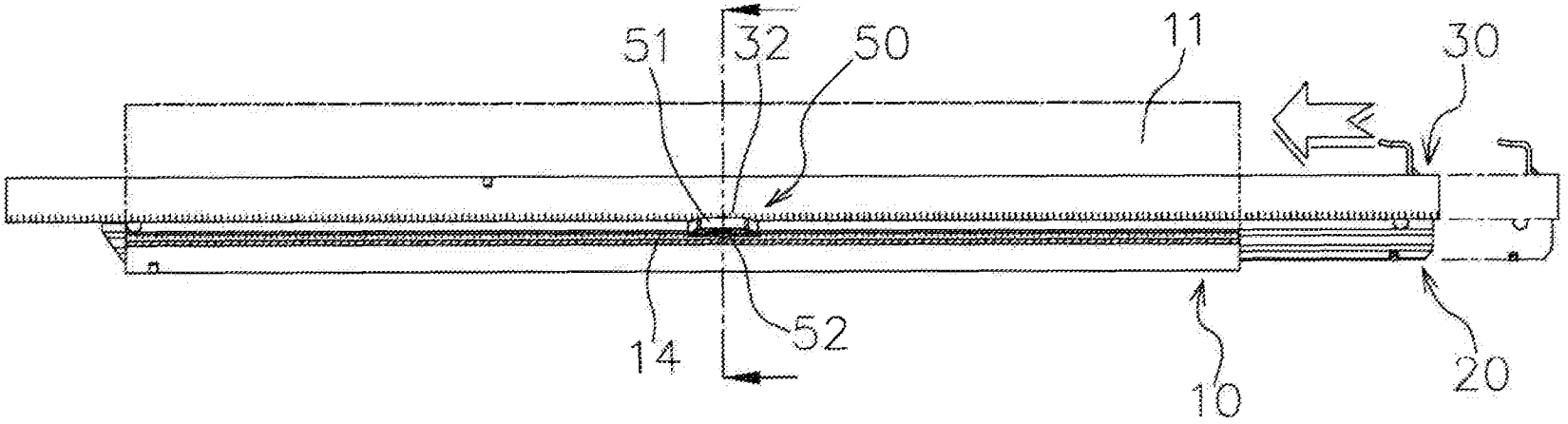
FIG. 5 is a schematic view of the present invention in operation.

Referring to FIGS. 5 and 6 which illustrate the present invention of a track-based synchronous interlinking device in operation. The external track 30 pulled or pushed is shifted with the roller 52 which is driven by the knurl pattern 32 and simultaneously contacts and rolls on the knurl pattern 14 of the lower track 10. As such, the central track 20 is also driven to shift synchronously by the external track 30 for completion of movement relative to the lower track 10 based on a synchronous triple-track interlinking operation among the lower track 10, the central track 20 and the external track 30.

The roller 52 whose diameter is smaller than that of a known toothed wheel is effective in reducing the whole track assembly's height and in favor of high applicability and a demand for designing a compact slide track. The roller 52 which is manufactured with soft material featuring flexibility or elasticity and slants is able to absorb force induced by the external track 30 which tilts (FIG. 6), realize neither deviation of the lower track's axle attributed to down force (weight) nor unsmooth operation and departure of the track assembly from a cabinet, and ensure a product's quality and life cycle.

It can be seen that the present invention of a track-based synchronous interlinking device effectively satisfies a synchronous triple-track interlinking operation during relative slides, keeping superior smooth and accurate slides, conforming to economic efficiency and a demands for better track design, and positively promoting practicability, texture perception, and competitiveness of a product.

Accordingly, the present invention significantly meets patentability and is applied for the patent. However, the above descriptions are only preferred embodiments which do not limit the scope of the present invention; any equivalent change or improvement without departing from spirit of the present invention should be incorporated in claims herein.

What is claimed is:

1. A track-based synchronous interlinking device, comprising:

a lower track having a convex surface being oblique relative to a longitudinal axis of the lower track, the oblique convex surface having a knurl pattern thereon;

a central track which slides relative to said lower track and includes at least one pilot hole;

an external track which slides relative to said central track and comprises a knurl pattern obliquely opposite to said knurl pattern on said lower track;

a synchronous interlinking device comprising (a) a roller bracket positioned by inserting a locator in said at least one pilot hole on one side of said central track and (b) a roller featuring flexibility and elasticity, rotationally connected to said roller bracket, and being slanted relative to the longitudinal axis of the lower track so that sides of the roller contact said lower track's knurl pattern and said external track's knurl pattern for allowing relative slides based on a synchronous triple-track interlinking operation among said lower track, said central track and said external track;

wherein said roller bracket contains a hollow roller accommodation space having two raised joining columns extending toward each other and being centrally situated within said hollow roller accommodation space, and said roller has an axial hole in which said two raised joining columns are received, said roller bracket further comprises two hollow side compartments, each of which is beside said roller accommodation space.

2. The track-based synchronous interlinking device according to claim 1 wherein said lower track comprises a track part having a slide track space in which said central track is held.

3. The track-based synchronous interlinking device according to claim 2 wherein said lower track further comprises a dead plate fixed on a cabinet wall.

4. The track-based synchronous interlinking device according to claim 2 wherein said lower track's knurl pattern is beside said slide track space of said track part.

5. The track-based synchronous interlinking device according to claim 2 wherein said knurl pattern on said lower track is equal to or shorter than said track part in length.

6. The track-based synchronous interlinking device according to claim 1 wherein said external track has a slide track space in which said central track is held.

7. The track-based synchronous interlinking device according to claim 1 wherein said knurl pattern on said external track is equal to or shorter than said external track in length.

8. The track-based synchronous interlinking device according to claim 1 wherein said central track comprises a central track bottom and a central track top in order to accommodate a ball bearing carriage between said central track bottom and said lower track as well as another ball bearing carriage between said central track top and said external track.

9. The track-based synchronous interlinking device according to claim 1 wherein said roller bracket has a resisting part outside said locator.

10. The track-based synchronous interlinking device according to claim 3 wherein said oblique convex surface extends away from said dead plate.

* * * * *